US007450475B2

(12) United States Patent
Seyr

(10) Patent No.: US 7,450,475 B2
(45) Date of Patent: Nov. 11, 2008

(54) ELAPSED TIME INDICATOR WITH MOVING DISC

(75) Inventor: Ernst Seyr, Linz (AT)

(73) Assignee: Eterna AG Uhrenfabrik, Grenchen (CH)

( * ) Notice: Subject to any disclaimer, the term of this patent is extended or adjusted under 35 U.S.C. 154(b) by 0 days.

(21) Appl. No.: 11/208,036

(22) Filed: Aug. 19, 2005

(65) Prior Publication Data

US 2006/0039243 A1 Feb. 23, 2006

(30) Foreign Application Priority Data

Aug. 19, 2004 (CH) ..... 1364/04

(51) Int. Cl.
*G04F 10/00* (2006.01)

(52) U.S. Cl. ..... 368/107; 368/223

(58) Field of Classification Search ..... 368/107, 368/223, 76, 77, 233, 108–113, 221
See application file for complete search history.

(56) References Cited

U.S. PATENT DOCUMENTS 372,074 A * 10/1887 Kuhn ..... 368/229
2,437,621 A * 3/1948 Strate ..... 235/78 R
2,619,793 A * 12/1952 Olschwang ..... 368/233
4,006,588 A * 2/1977 McMahon et al. ..... 368/233
4,206,592 A * 6/1980 Maue ..... 368/233

* cited by examiner

*Primary Examiner*—Edwin A. Leon
*Assistant Examiner*—Thanh S Phan
(74) *Attorney, Agent, or Firm*—The Webb Law Firm

(57) ABSTRACT

An elapsed time indicator has a see-through region which has a plurality of windows. These windows are each congruent and are arranged at a uniform angular distance from one another. A solid disc is arranged below the said see-through region and has at least two sectors which have different colours and/or designs. In this case, the solid disc is rotatable and the see-through region is firmly connected to the dial plate. The solid disc has a number of radial sectors, adjacent sectors in each case having different colours or grey tints, and each sector has approximately the width of a window.

9 Claims, 2 Drawing Sheets

ELAPSED TIME INDICATOR WITH MOVING DISC

BACKGROUND OF THE INVENTION

1. Field of the Invention

The invention relates to an elapsed time indicator having a see-through region which has a plurality of windows, these windows each having a congruent shape and being arranged at a uniform angular distance from one another, and having a solid disc which is arranged below the said see-through region and has at least two sectors which have different colours and/or designs.

2. Description of Related Art

A number of such elapsed time indicators have been disclosed by the prior art. This normally involves indications in seconds or indications within this time range. Indications in minutes or within the hour range are also involved.

U.S. Pat. No. 5,077,708 has a small rotating disc in the top region of the number "12", this disc having a slot which receives a different colour in the final minute within the range and thus indicates this final minute to the user.

GB 2,206,712 shows a timepiece with a vernier. A disc having twelve graduations and an hour indicator rotates below a stationary disc having eleven graduations which lie above the twelve graduations and which then form the minutes indicator.

EP 1 168 112 proposes a rotating system in accordance with this principle, this system having a quicker change of the two colours.

In the device establishing the generic type according to EP 0 177 440, each second is indicated by a disc rotated by 180 degrees, so that two colours are visible in the windows one behind the other and this in each case for one second. Round windows and sector-shaped colour zones are disclosed.

This indicator requires a stepping motor which rotates abruptly by 180 degrees after every second.

SUMMARY OF THE INVENTION

Based on this prior art, the object of the invention is to realize a simpler version of mechanical blinking.

This object is achieved according to the invention in that either the solid disc is rotatable and the see-through region is firmly connected to the dial plate or the see-through region is rotatable and the solid disc is firmly connected to the dial plate, in that the solid disc has a number of radial sectors, adjacent sectors in each case having different colours or grey tints, and in that each sector has approximately the width of a window.

Owing to the fact that sectors of the same size are arranged next to one another, the rotary speed of the rotating disc can be greatly reduced. Instead of a stepping motor which rotates abruptly by 180 degrees after every second, a stepping motor can now be used which, at a width of the slot of N degrees, rotates the disc further by N degrees every second. In a preferred embodiment, N degrees is selected to be equal to 5.625 degrees, so that only a small stepping movement is required every second in order to achieve a change of colour.

Especially preferred is the configuration having four slots which are arranged at an angle of 90 degrees to one another, in particular if two colours are provided and then the two opposite slots always have the same colour.

BRIEF DESCRIPTION OF THE DRAWINGS

The invention will now be explained in more detail by way of example with reference to the drawings and an exemplary embodiment. In the drawings.

DESCRIPTION OF THE PREFERRED EMBODIMENTS

Figure 3:
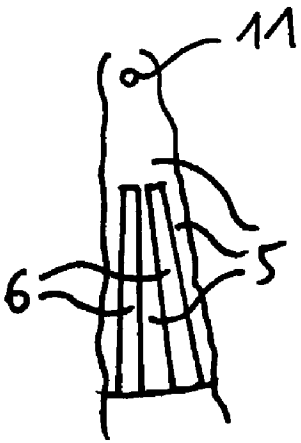
FIG. 3 shows a schematic plan view of a detail of the disc.

The plane of a dial plate is designated by reference numeral 1. This dial plate has an opening 2, through which a drive spindle 3 of a rotatable disc 4 is arranged. The rotatable disc 4 has regions 5 in a basic colour, design or tinting and has segments 6.

In mathematical terms, the segments 6 are in each case parts of a circular ring. The segments 6 are finished in another colour, with design or shading different from the regions 5.

The segments 6 all cover an identical predetermined angular sector of, for example, 5.625 degrees. Those sections of the regions 5 which are provided between two segments 6 cover the same predetermined angular sector of, in this case, 5.625 degrees. The disc 4 therefore has thirty-two segments 6, which are separated by thirty-two respective regions 5 of the same size. Of course, the parts 6 of the circular rings may also be extended right into the region of the centre of the disc 4. The ease with which the two regions can be distinguished graphically is important.

On the region of the opening 2, a cover plate 7 is fastened to the dial plate 1 using four screws 8. The cover plate 7 has a flat surface 10 which is of one colour if possible and in this case has four slots 9 which are arranged at an equal angular distance from one another, namely 90 degrees. The slots g likewise correspond to parts of circular rings and each congruently cover a segment 6 or a region 5 located in between. Here, therefore, they likewise cover an angular sector of 5.625 degrees.

They may also cover a smaller angular sector. The segments 6 and regions 5 may then also be designed to be "more imprecise", since only core areas of segments 6 and regions 5 are shown.

Figure 1:
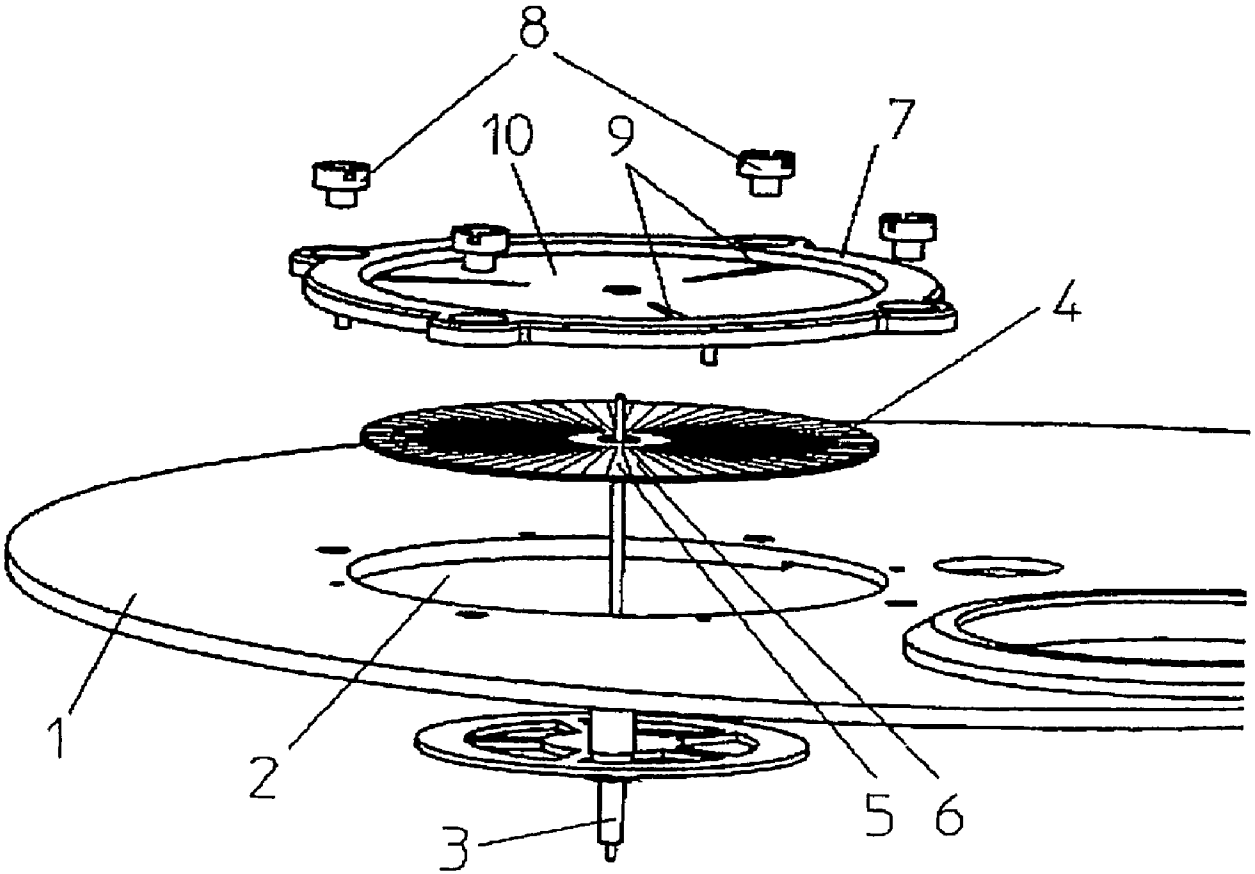
FIG. 1 shows a schematic perspective exploded view of a detail of a dial plate with an elapsed time indicator according to an exemplary embodiment of the invention.
Figure 2:
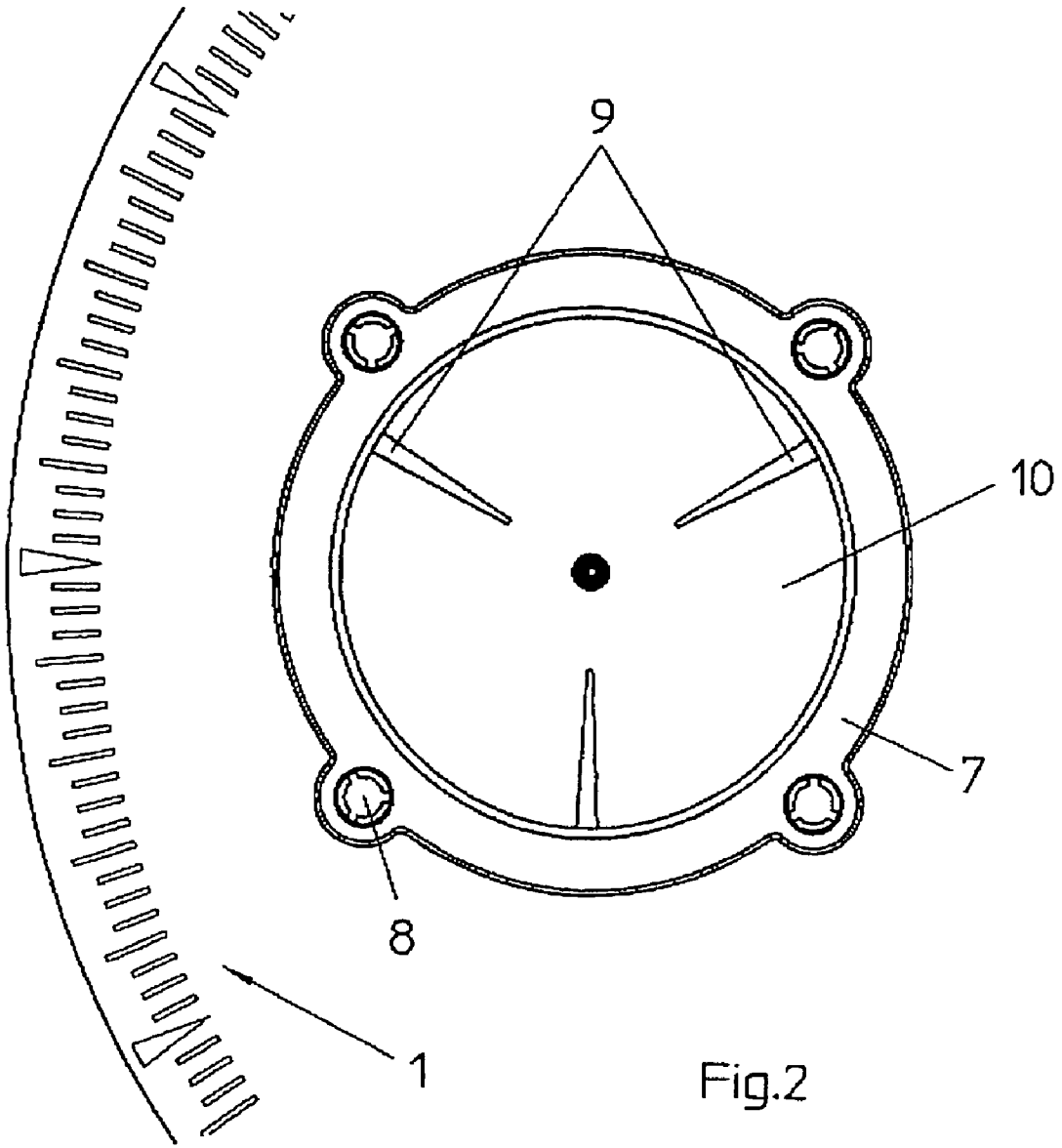
FIG. 2 shows a schematic plan view of the region of the elapsed time indicator according to FIG. 1.

FIG. 2 shows a schematic plan view of the region of the elapsed time indicator according to FIG. 1. In addition, of the dial plate 1, a detail of the edge markings is shown in order to indicate that the elapsed time indicator is arranged eccentrically to the main axis of hands of a timepiece.

In the configuration according to FIG. 1, the segments 6 or the regions 5 then appear in two slots 9 opposite one another. If the disc is rotated further by 5.625 degrees, the indication changes, since the regions 5 or respectively the segments 6 can be seen in the same opposite slots 9.

It is thus possible with only slight angular movements to realize, for example, a seconds indicator if, after every second, a stepping motor rotates the disc further by the said 5.625 degrees. This corresponds to a rotation by 337.5 degrees in one minute.

For the purposes of illustration, FIG. 3 shows a highly schematic plan view of a detail of the disc 4. The segments 6 following one another and defined by the edge of the disc 4 can be seen, as can the regions 5 lying in between, which also extend up to the hole 11 in the centre of the disc 4.

It is clear that other configurations of the slots are also possible. The may have an arrow shape (also in the resolving direction), and may consist of circles or other shapes. The large number of segments 6 and regions 5, which, to the extent of the respective adjusting angle, require only small changes in the rotary position per cycle signal, is important.

Other configurations of see-through regions 9 and disc patterns may be:

| Slots/angular distance | Segments | Rotary angle (in degrees) |
|---|---|---|
| 4/90 | 2 * 32 | 5.625 |
| 4/90 | 2 * 16 | 11.25 |
| 3/120 | 2 * 33 | 5.454 |
| 5/72 | 2 * 30 | 6.0 |
| 6/60 | 2 * 30 | 6.0 |
| 8/45 | 2 * 32 | 5.625 |

In an exemplary embodiment not shown in the figures, a circle is formed on the dial plate 1 in a fixed position with the segments 5, 6 of alternating colours. Rotating above the dial plate 1 is a pierced disc which has, for example, only the colour of the dial plate. This means that the apertures of the disc arranged above the dial plate 1 correspond exactly to the slots 9 in the exemplary embodiment according to the drawing. During the rotation of the disc, the different colours or patterns appear in the apertures as in the embodiment according to FIG. 2, for example at one-second intervals. In appearance, this arrangement can resemble the illustration according to FIG. 2 if the surface 10 is rotatable and has the apertures 9, and the segments which can be recognized through the apertures 9 are the fixed markings/colours/designs on the dial plate 1.

The invention claimed is:

1. An elapsed time indicator comprising:

a see-through region having a plurality of windows, wherein the windows are congruently shaped and are arranged at a uniform angular distance from one another; and a solid disc arranged below the see-through region including a plurality of adjacent radial sectors, wherein at least two adjacent radial sectors contain different indicia, wherein either the solid disc is rotatable and the see-through region is connected to a dial plate or the see-through region is rotatable and the solid disc is connected to the dial plate, and further wherein each adjacent radial sector is approximately the width of a window, and wherein the plurality of windows of the see-through region is arranged such that relative rotation between the solid disc and the see-through region effects a simultaneous change of the indicia appearing in the plurality of windows of the see-through region, and wherein the indicia appearing in the plurality of windows as a result of the relative rotation between the solid disc and the see-through region are the same indicia.

2. The elapsed time indicator according to claim 1, wherein the indicia are one of colours, designs, and grey tints.

3. The elapsed time indicator according to claim 2, wherein the see-through region is a disc mounted on the dial plate, wherein the disc includes the windows.

4. The elapsed time indicator according to claim 3, wherein the windows are radial slots.

5. The elapsed time indicator according to claim 4, wherein the slots begin at a predetermined distance from the centre of the disc.

6. The elapsed time indicator according to claim 4, wherein the elapsed time indicator includes one of four, four, three, five, six, and eight slots at an angular distance of 90, 90, 120, 72, 50 or 45 degrees, respectively, further wherein thirty-two, sixteen, thirty-three, thirty, thirty, thirty-two respectively adjacent segments have a requisite rotary angle of 5.625, 11.25, 5.454, 6.0, 6.0 or 5.625 degrees per cycle, respectively.

7. The elapsed time indicator according to claim 2, wherein each window covers an angular sector of 5.625 degrees.

8. The elapsed time indicator according to claim 7, wherein the windows are radial slots.

9. The elapsed time indicator according to claim 3, wherein the elapsed time indicator includes one of four, four, three, five, six, and eight windows at an angular distance of 90, 90, 120, 72, 50 or 45 degrees, respectively, further wherein thirty-two, sixteen, thirty-three, thirty, thirty, thirty-two respectively adjacent segments have a requisite rotary angle of 5.625, 11.25, 5.454, 6.0, 6.0 or 5.625 degrees per cycle, respectively.

* * * * *